US006802242B1

(12) United States Patent
Steinke et al.

(10) Patent No.: US 6,802,242 B1
(45) Date of Patent: Oct. 12, 2004

(54) PNEUMATIC CIRCUIT CONTROL SYSTEM

(75) Inventors: Joseph Henry Steinke, Mission Viejo, CA (US); Sanjay V. Sherikar, Mission Viejo, CA (US)

(73) Assignee: Control Components, Inc., Rancho Santa Margarita, CA (US)

( * ) Notice: Subject to any disclaimer, the term of this patent is extended or adjusted under 35 U.S.C. 154(b) by 74 days.

(21) Appl. No.: 10/390,080

(22) Filed: Mar. 17, 2003

(51) Int. Cl.[7] ..... F15B 11/08; F15B 13/04
(52) U.S. Cl. ..... 91/454; 91/464
(58) Field of Search ..... 60/407; 91/454, 91/455, 456, 461, 464, 465, 466, 459

(56) References Cited

U.S. PATENT DOCUMENTS 4,643,236 A * 2/1987 O'Brien et al. ..... 144/208.8
5,435,228 A * 7/1995 Snitgen ..... 91/444
6,349,627 B1 * 2/2002 Nusche ..... 91/454
6,357,335 B1 * 3/2002 Lafler et al. ..... 91/459

* cited by examiner

*Primary Examiner*—Thomas E. Lazo
(74) *Attorney, Agent, or Firm*—Stetina Brunda Garred & Brucker

(57) ABSTRACT

A pneumatic control system is provided for positioning a piston within a cylinder and comprises a positioner for regulating the flow of compressed air into and out of first and second ends of the cylinder. First and second large boosters force compressed air into the respective first and second ends. First and second small boosters and first and second quick exhaust valves collectively exhaust compressed air out of the respective first and second ends. First and second small and large booster check valves interposed between the directional valve and the respective first and second small and large boosters are oriented such that the flow of compressed air through the signal lines and into the first and second small and large boosters may be blocked for increasing the sensitivity of the positioning of the piston.

13 Claims, 2 Drawing Sheets

PNEUMATIC CIRCUIT CONTROL SYSTEM

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention pertains generally to fluid flow control and, more particularly, to a control system for a pneumatic circuit with improved cylinder sensitivity effected through the use of check valves for selectively isolating components on either end of the cylinder.

Pneumatic systems typically involve a source of compressed air that is routed through a network of pipes. The compressed air is typically obtained from a compressor which is usually driven by an electric motor or an internal combustion engine. The compressed air is routed to a positioner which ultimately controls the flow of compressed air to and from a cylinder in order to move a piston sealed within the cylinder. The piston may have a shaft extending out of the cylinder and connected to the component to be moved. The positioner provides pneumatic signals in the form of compressed air which is routed to control valves or boosters. The boosters are selectively opened and closed to regulate the flow of the compressed air to and from the cylinder. The boosters receive the pneumatic signals and may be opened and closed by pneumatic pilots connected on either end of each booster. The pneumatic pilots of the boosters are connected to the positioner through signal lines. The boosters are also connected to the source of compressed air through feed lines. The signal lines are typically of a smaller diameter than feed lines because they supply and exhaust compressed air into and out of the cylinder at relatively low flow rates. However, at higher flow rates, the positioner provides a greater flow of compressed air into the signal lines with a pressure sufficient to actuate the pneumatic pilots of the volume boosters. The actuated boosters allow compressed air to flow from the larger diameter feed lines into and out of the cylinder at the higher rate.

The pneumatic system moves the piston by forcing air into a first end of the cylinder while simultaneously withdrawing or exhausting air out of a second end of the cylinder in order to advance the piston along the length of the cylinder. Conversely, the pneumatic system may also force air into the second end of the cylinder while simultaneously exhausting air out of the first end of the cylinder in order to retract the piston in the opposite direction. By driving the air into alternate ends of the cylinder, the piston is moved such that the shaft can be displaced in any position for doing useful work. The compressed air may pass through a regulator to control the amount of pressure available in the pneumatic circuit. The compressed air may also pass through a filter to clean the air to prevent damage to components thereby ensuring that the components have a long and reliable working life.

Pneumatic systems are commonly used in large scale applications such as in power plants and refineries for controlling system components such as a working valve. In such applications, it may be desirable to quickly and repeatedly position the piston to within thousandths of an inch. In order to quickly and precisely position the piston, a pair of boosters may be connected to the first end of the cylinder arid another pair of boosters may be connected to the second end of the cylinder. The first pair of boosters may include one booster configured for "pushing" air into the first end of the cylinder with the other of the pair configured to "pull" air from the first end. Likewise, the second pair may include one "pusher" and one "puller" booster. Quick exhaust valves may also be installed between the puller boosters and the respective first and second ends of the cylinder. Operating in conjunction with the puller boosters, the quick exhaust valves exhaust air out of the cylinder at high flow rates. Although configured to respectively supply and exhaust air into and out of the cylinder at high flow rates, the pusher and puller boosters also have the individual capability to respectively exhaust and supply air out of and into the cylinder, although at significantly lower flow rates. At low flow rates, the pusher boosters on the first and second ends of the cylinder supply compressed air to the cylinder solely through the smaller diameter signal lines. However, at higher flow rates, the positioner provides sufficient pressure of compressed air to the pneumatic pilots through the signal lines such that the pusher boosters are actuated. Depending on whether the compressed air is to be supplied to the first end or to the second end of the cylinder, the first or second actuated pusher booster will allow compressed air to flow to the first or second end through the larger diameter feed lines. For example, if compressed air is to be supplied to the first end at a high flow rate, then the pusher booster connected to the first end provides the majority of compressed air to the first end while the puller booster connected to the first end provides a negligible amount of compressed air. Simultaneously, the puller booster connected to the second end exhausts the majority of compressed air from the second end while the pusher booster connected to the second end exhausts a negligible amount of compressed air.

The sensitivity of the boosters in responding to pneumatic signals is controlled by adjustable restrictions or needle valves which are incorporated into the boosters. The needle valves are connected in parallel across the boosters at the pneumatic pilots. When the pressure of compressed air acting on the pneumatic pilots reaches a preset level, the booster toggles from a "closed" or null position to a supply or exhaust position. In either the supply or exhaust position, a greater flow of compressed air from feed lines may pass through the boosters and enter or exit alternate ends of the cylinder. Thus, the adjustable restrictions provide a means for setting the point at which the booster are activated by the pneumatic pilots so that the booster toggles from the null position to either the supply or the exhaust position.

As mentioned above, the positioner adjusts the position of the piston by forcing air into alternate ends of the cylinder. However, due to the compressible nature of air, dynamic instability may result within the pneumatic circuit such that the piston is difficult to precisely and rapidly position. For example, within typical pneumatic circuits, when there are active components such as a pusher and a puller booster connected to a first end of the cylinder, the adjustment of the sensitivity of the pusher booster may affect the total capacity of the compressed air into the cylinder on that same first end of the cylinder. More specifically, in the example, if the sensitivity of the pusher booster in responding to pneumatic signals is increased, the pusher booster will toggle to the supply position in response to relatively small pneumatic signal changes. However, the non-activated puller booster will simultaneously provide a small flow of compressed air to the cylinder through the signal lines. Because of the compressibility of air, the piston will not start to move toward the second end until both the pusher and puller booster on the first end have sufficiently pressurized. Thus, the overall speed of the piston in responding to signal changes is reduced. In addition, the position of the piston within the cylinder may fluctuate as the boosters respond to small signal changes, resulting in dynamic instability. In addition, because the non-activated booster on either side of the cylinder must supply compressed air through signal lines each time the piston moves, the total requirement of compressed air that must be provided by the positioner to regulate the piston position is increased.

The prior art discloses several pneumatic circuits with control systems designed to improve the accuracy and response time with which the piston may be positioned within the cylinder. One such prior art device includes an actuator system which modulates a linear output shaft associated with a working control valve in response to a control signal input. The system includes a feedback control link, a pneumatically controlled hydraulic valving system and a hydraulic cylinder and piston controlled by the hydraulic valving system. The hydraulic valving system includes a three-position, four-way valve actuated by pneumatic binary output signals from a signal conditioner which is in turn controlled by the positioner. Hydraulic flow to the three-position, four-way valve may also be controlled from the signal conditioner in response to positioner output for effective actuation of the hydraulic piston and cylinder assembly. Although the system exhibits rapid response time and high accuracy in positioning the piston with n the cylinder, the system is necessarily complex and costly in that it combines hydraulic circuit components with pneumatic circuit components. Furthermore, the system disclosed in the reference is not easily retrofittable into existing pneumatic circuits.

As can be seen, there exists a need in the art for a pneumatic control system wherein the opening and closing speeds of the control valves or volume boosters can be adjusted with minimal impact on the overall speed of the piston within the cylinder. In addition, there exists a need in the art for a pneumatic control system wherein the total requirement of compressed air out of the positioner is minimized. Furthermore, there exists a need in the art for a pneumatic control system wherein the interactive effects of the volume boosters on the first and second ends of the cylinder may be eliminated. Finally, there exists a need in the art for a pneumatic control system that may be retrofitted into existing pneumatic circuits.

BRIEF SUMMARY OF THE INVENTION

The present invention specifically addresses and alleviates the above referenced deficiencies associated with pneumatic control systems. More particularly, the present invention is an improved pneumatic control system for positioning a piston within a cylinder of a pneumatic circuit. As will be demonstrated below, the pneumatic control system of the present invention differs from pneumatic control systems of the prior art in that it utilizes booster check valves for increasing the responsiveness of the pneumatic control system to pneumatic signals.

The pneumatic control system is configured for positioning a piston within a cylinder having first and second ends by manipulating a flow of compressed air such that the position of the piston may be regulated. A compressed air source provides compressed air to the pneumatic circuit. A filter regulator may be included in the pneumatic circuit to reduce the pressurization level of the source of air to a safe working level. The filter regulator also filters the source of compressed air to remove contaminates.

A positioner regulates the flow of compressed air into and out of the first and second ends of the cylinder. A piston position signal representative of an actual piston position may be supplied to the positioner. The positioner converts the piston position signal to a pneumatic signal representative of a desired piston position. In response to the pneumatic signal, the flow of compressed air may be alternately directed into the first and second ends for respectively retracting and extending the piston to correct for disparity between the actual piston position and the desired piston position.

A directional valve fluidly connected to the compressed air source includes a pneumatic pilot connected to the air source. When pressure in the signal line overcomes a biasing spring force, the directional valve opens such that compressed air may be delivered to one of the two signal lines exiting the directional valve. The directional valve may be set to close when the pressure of the compressed air drops below 50 psi, as a failsafe mechanism.

Importantly, first and second small and first and second large booster check valves are utilized to block the flow of compressed air in one direction of the pneumatic circuit and allow free flow of the compressed air in the opposite direction. The first and second small booster check valves are oriented such that compressed air flowing toward first and second small boosters may be blocked. Conversely, the flow orientations of the first and second large booster check valves are such that compressed air may flow only toward first and second large boosters. Advantageously, the first and second small booster check valves isolate the first and second small boosters such that compressed air is blocked from flowing into the first and second small boosters. Likewise, the first and second large booster check valves operate to isolate the first and second large boosters such that compressed air is blocked from flowing through the signal lines toward the directional valve. By selectively isolating the first and second small and large boosters, the total volume of compressed air that would otherwise flow into the respective first and second small and large boosters is reduced. By reducing the total amount of compressed air that is required in order to effect a given piston movement, the speed with which the boosters may be activated is reduced. The reduced total volume of compressed air that would otherwise be required to effect a given piston movement ultimately allows for more effective control of the piston within the cylinder.

The first small and large boosters are positioned on the first end of the cylinder for supplying and exhausting compressed air into and cut of the first end of the cylinder. The second small and large boosters are positioned on the second end of the cylinder for supplying and exhausting compressed air into and out of the second end of the cylinder. The first and second small and large boosters each include pneumatic pilots connected to the air source via signal lines for overcoming the spring bias to force the booster to either one of the two alternate positions. The boosters include adjustable restrictions for regulating the sensitivity of the boosters in responding to changes in pressure of the compressed air provided by the positioner through the signal lines.

First and second quick exhaust valves operate in conjunction with the first and second small boosters to quickly exhaust compressed air out of the respective first and second ends of the cylinder at high flow rates. At low flow rates, the first and second small boosters alternately exhaust air out of the second end unaided by the first and second quick exhaust valves. At high flow rates, the first and second quick exhaust valves are initiated by the increased pressure differential resulting from the initial low rate of alternate exhaustion of compressed air out of the first and second small boosters.

The cylinder is interposed between the first large booster and first quick exhaust valve and the second large booster and second quick exhaust valve at the respective first and second ends. Sealed within the cylinder is the piston. The piston is connected to a shaft which extends out of the cylinder, the shaft being connectable to a component to be moved.

BRIEF DESCRIPTION OF THE DRAWINGS

These, as well as other features of the present invention, will become more apparent upon reference to the drawings wherein.

Figure 1:
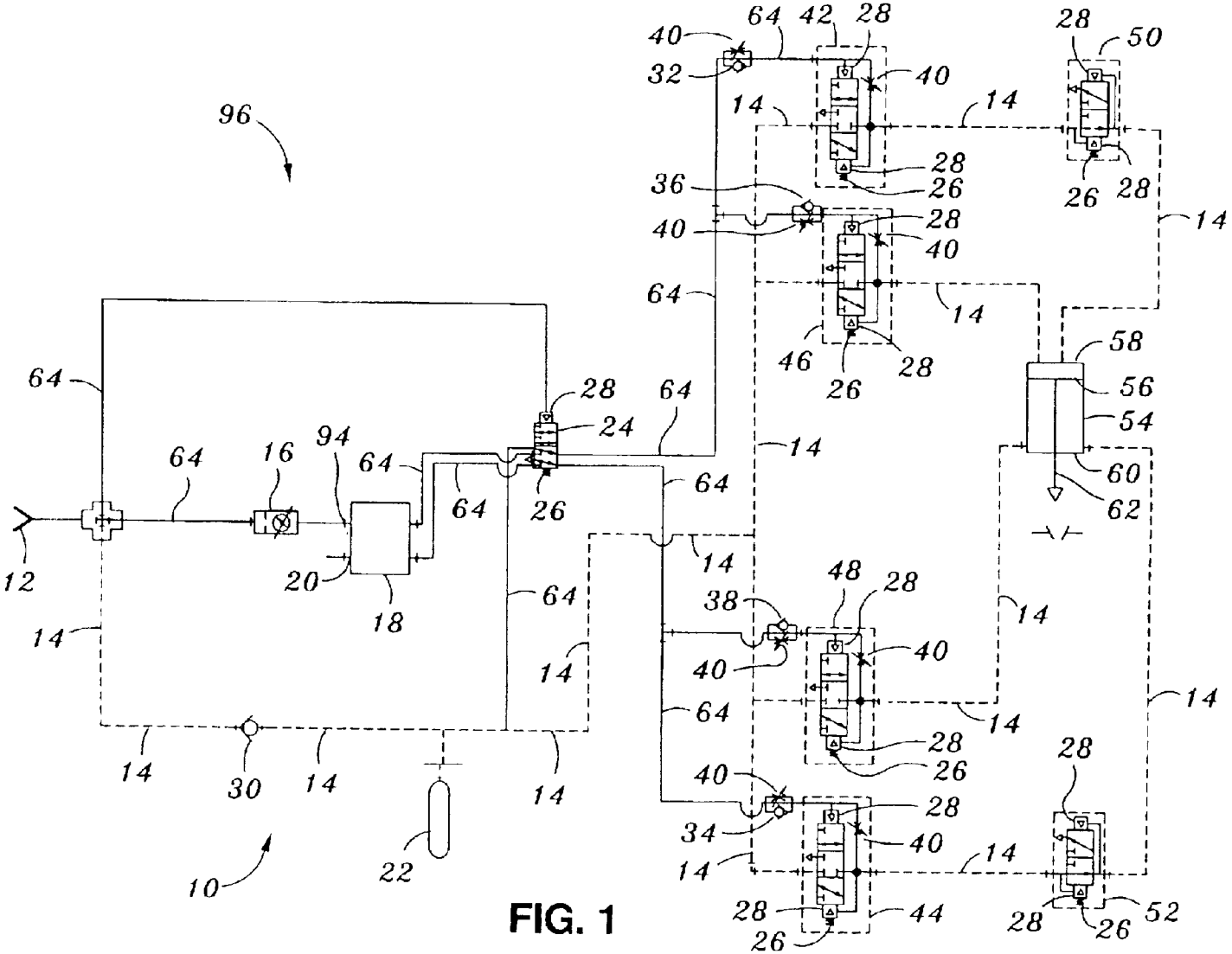
FIG. 1 is a schematic diagram of a pneumatic control system illustrating the connective relationship of first and second small and first and second large booster check valves with first and second small and first and second large boosters in accordance with a first embodiment of the present invention.

The drawing employs conventional graphic symbols for fluid power diagrams as specified in American National Standards Institute Y32.10.

DETAILED DESCRIPTION OF THE INVENTION

Referring now to the drawings wherein the showings are for purposes of illustrating preferred embodiments of the present invention and not for purposes of limiting the same, FIG. 1 is a schematic diagram of a pneumatic control system 96 illustrating the connective relationship of first and second small booster check valves 32, 34, and first and second large booster check valves 36, 38 with first and second small boosters 42, 44, and first and second large boosters 46, 48 in accordance with a first embodiment of the present invention. The pneumatic control system 96 is configured for positioning a piston 56 within a cylinder 54 having first and second ends 58, 60 by manipulating a flow of compressed air such that the position of the piston 56 may be regulated. A compressed air source 12 provides compressed air to a pneumatic circuit 10 of the pneumatic control system 96. Compressed air may be provided by a compressor which is usually driven by an electric motor or an internal combustion engine. Optionally, a filter regulator 16 may be included in the pneumatic circuit 10, as can be seen in FIG. 1. The filter regulator 16 fluidly communicates with the source 12 of compressed air through a signal line 64. The source 12 of compressed air may be provided at a much higher pressurization level than can be utilized by the pneumatic circuit 10. Because the pneumatic circuit 10 is preferably designed to operate at a lower level of pressurization, the filter regulator 16 reduces the pressurization level of the source 12 of air to a safe working level. The filter regulator 16 of the pneumatic circuit 10 of the present invention may be preset to a maximum of 150 psi. The filter regulator 16 also filters the source 12 of compressed air to remove contaminates, oil and water-vapor that may harm downstream components.

Also shown in FIG. 1 is a positioner 18 incorporated into the pneumatic circuit 10 of the present invention. The positioner 18 is in fluid communication with the filter regulator 16 through a signal line 64 at a supply port 94. As will be explained in more detail below, the positioner 18 regulates the flow of compressed air into and out of the first and second ends 58, 60 of the cylinder 54. A piston position indicator may be mounted adjacent the cylinder 54 for sensing an actual position of the piston 56 within the cylinder 54 and generating a piston position signal in response thereto. The piston position signal may be supplied to the positioner 18 at a signal input port 20 through a pneumatic control line (not shown) connected to the cylinder 54. In this manner, the positioner 18 may utilize 3–15 psi pneumatic control signals supplied from a distributed microelectronic control system (DCS). It is also contemplated that the piston position signal may be electronically transmitted to the positioner 18 via an electrical line. The piston position indicator may be comprised of pickup magnets mounted on the piston 56. A feedback transducer may be mounted on the cylinder 54 and may be electrically connected to the positioner 18. The positioner 18 may be fitted with current-to-pressure transducers for 4–20 mA signal inputs supplied from an electronic controller. Feedback on the position of the piston 56 within the cylinder 54 may also be provided to the positioner 18 by a feedback arm mechanically connected to the piston 56. The positioner 18 converts the piston position signal to a pneumatic signal representative of a desired position of the piston 56. In response to the pneumatic signal, the flow of compressed air may be alternately directed into the first and second ends 58, 60 for respectively retracting and extending the piston 56 to correct for disparity between the actual position of the piston 56 and the desired position thereof.

A directional valve 24 is schematically illustrated in FIG. 1 as being fluidly connected to the positioner 18 through the two signal lines 64 exiting the positioner 18. The directional valve 24 is also fluidly connected to the compressed air source 12 through signal line 64. The directional valve 24 is a two-position, pneumatically controlled, spring centered valve. A spring 26 biases the directional valve 24 to a normally "closed" or fail safe position. Although shown in FIG. 1 as having a mechanical biasing spring 26, it s contemplated that other biasing means may be utilized with the directional valve 24 for biasing in the normally closed position. For example, the directional valve 24 may be actuated by an electrical solenoid in response to an electrical signal indicating a loss of pneumatic pressure in the pneumatic circuit 10. The directional valve 24 includes a pneumatic pilot 28 connected to the air source 12 by signal line 64. When pressure in the signal line 64 overcomes the force of the spring 26, the directional valve 24 opens such that compressed air may be delivered to one of the two signal lines 64 exiting the directional valve 24. The directional valve 24 is configured to open at a preset pressurization level of the compressed air for enabling the flow thereof to pass between the positioner 18, the compressed air source 12, and the cylinder 54. The directional valve 24 may be set to open when the pressurization level roaches 50 psi. Conversely, the directional valve 24 may be set to close when the pressure of the compressed air drops below 50 psi, as a fail safe mechanism. In the open position, the directional valve 24 receives the compressed air from the positioner 18 and directs it to the appropriate end of the cylinder 54 depending on whether the piston 56 is to be extended or retracted.

Importantly, included within the pneumatic circuit 10 of the present invention as schematically illustrated in FIG. 1 are the first small booster check valve 32 and the first large booster check valve 36 which are each in fluid communication with the directional valve 24 via signal lines 64. Additionally, the second small booster check valve 34 and the second large booster check valve 38 are each in fluid communication with the directional valve 24 via signal lines 64. The first and second small and large booster check valves 32, 34, 36, 38 are also in fluid communication with the respective first and second small and large boosters 42, 44, 46, 48 via signal lines 64. The first and second small and large booster check valves 32, 34, 36, 38 are utilized to block the flow of compressed air in one direction of the pneumatic circuit 10 and allow free flow of the compressed air in the opposite direction. In the schematic illustration of FIG. 1, the first and second small booster check valves 32, 34 are oriented such that compressed air flowing toward the first and second small boosters 42, 44 from the directional valve 24 may be blocked. Specifically, the flow orientations of the first and second small booster check valves 32, 34 are such that compressed air may flow only away from the first and second small boosters 42, 44. Conversely, the flow orientations of the first and second large booster check valves 36, 38 are such that compressed air may flow only toward the first and second large boosters 46, 48.

Advantageously, the first and second small booster check valves 32, 34 operate to selectively isolate the first and second small boosters 42, 44 such that compressed air is blocked from flowing into the first and second small boosters 42, 44, as will be explained in more detail below. Likewise, first and second large booster check valves 36, 38 operate to isolate the first and second large boosters 46, 48 such that compressed air is blocked from flowing through the signal lines 64 toward the directional valve 24. By selectively isolating the first and second small and large boosters, 42, 44, 46, 48, the total volume of compressed air that would otherwise flow into the respective first and second small and large boosters 42, 44, 46, 48 is reduced. By reducing the total amount of compressed air that is required in order to effect a given movement of the piston 56, the speed with which the boosters 42, 44, 46, 48 may be activated is reduced. The reduced total volume of compressed air that would otherwise be required to effect a given movement of the piston 56 ultimately allows for more effective control of the piston 56 within the cylinder 54. It is contemplated that the first and second small and large booster check valves 32, 34, 36, 38 are configured to have a cracking pressure of 1–2 psi. Cracking pressure is the amount of pressure that is required to initiate flow through the check valve. The first and second small booster check valves 32, 34 increase the responsiveness of the pneumatic control system 96 to pneumatic signal changes from the positioner 18.

Optionally, the first and second small and large booster check valves 32, 34, 36, 38 may each include an adjustable restriction 4C, as can be seen in FIG. 1. The adjustable restrictions 40 may be fluidly connected in parallel to the first and second small and large booster check valves 32, 34, 36, 38 for minimizing the compressed air differential pressure across the booster check valves 32, 34, 36, 38. The adjustable restrictions 40, which may configured as needle valves, allow for a selectively restrictable flow of compressed air in the direction opposite that which is blocked by the first and second small and large booster check valves 32, 34, 36, 38. The adjustable restrictions 40 may be included within the pneumatic circuit 10 such that the pressure differential across the check valves 32, 34, 36, 38 may be adjusted. Depending on the degree of sensitivity required for a given flow rate, a small amount of compressed air may be allowed to pass to the otherwise isolated first and second small and large boosters, 42, 44, 46, 48, in order to prevent unintentional activation thereof, as will be explained in greater detail below.

As shown in FIG. 1, the first small and large boosters 42, 46 are positioned on the first end 58 of the cylinder 54 for supplying and exhausting compressed air into and out of the first end 58 of the cylinder 54. The second small and large boosters 44, 48 are positioned on the second end 60 of the cylinder 54 for supplying and exhausting compressed air into and out of the second end 60 of the cylinder 54. In the schematic of FIG. 1, the first and second small and large boosters, 42, 44, 46, 48, are three-position, three-way, pneumatically controlled, spring centered valves. A spring 26 biases the boosters 42, 44, 46, 48, to a null or normally closed position, as shown in FIG. 1. The two alternate positions of the boosters 42, 44, 46, 48 are provided to alternately allow the compressed air to flow into or out of the cylinder 54. Although shown having a mechanical biasing spring 26, it is contemplated that other biasing means may be utilized, for biasing in the normally closed position. The boosters 42, 44, 46, 48, each include pneumatic pilots 28 connected to the air source 12 via signal lines 64 for overcoming the spring 26 bias to force the boosters 42, 44, 46, 48, to either one of the two alternate positions. Adjustable restrictions 40 are included with the boosters 42, 44, 46, 48 for regulating the sensitivity of the boosters 42, 44, 46, 48 in responding to changes in pressure of the compressed air provided by the positioner 18 through the signal lines 64 that are connected to the feed lines 14, which also connect to the respective first and second ends 58, 60 of the cylinder 54. The adjustable restrictions 40 are fluidly connected to the pneumatic pilots 28 of each booster 42, 44, 46, 48.

First and second quick exhaust valve 50, 52 operate in conjunction with the first and second small boosters 42, 44 to exhaust compressed air out of the respective first and second ends 58, 60 of the cylinder 54 at high flow rates. The first and second small boosters 42, 44 are fluidly connected in series via feed lines 14 to the respective first and second quick exhaust valves 50, 52. The first quick exhaust valve 50 is interposed between the first small booster 42 and the first end 58. The second quick exhaust valve 52 is interposed between the second small booster 44 and the second end 60. At high flow rates, the simultaneous forcing of compressed air into the first end 58 by the first large booster 46 and the exhaustion of compressed air out of the second end 60 by the combined efforts of the second small booster 44 and the second quick exhaust valve 52 operates to advance the piston 56 from the first end 58 to the second end 60. Conversely, the simultaneous forcing of compressed air into the second end 60 by the second large booster 48 and the withdrawal of compressed air out of the first end 58 by the combined efforts of the first small booster 42 and the first quick exhaust valve 50 operates to retract the piston 56 in the opposite direction.

At low flow rates, the first and second small boosters 42, 44 alternately exhaust air out of the second end 60 unaided by the first and second quick exhaust valves 50, 52. At high flow rates, the first and second quick exhaust valves 50, 52 are alternately initiated by the increased pressure differential resulting from the initial low exhaustion rate of compressed air out of the first and second small boosters 42, 44. In the schematic of FIG. 1, the first and second quick exhaust valves 50, 52 are two-position, three-way, pneumatically controlled, spring centered valves. A spring 26 biases the quick exhaust valves 50, 52 to a normally closed position, as shown in FIG. 1. An open position is provided to alternately allow the compressed air to flow out of the cylinder 54. Although shown having a mechanical biasing spring 26, it is contemplated that other biasing means may be utilized with the first and second quick exhaust valves 50, 52 for biasing in the normally closed position. The quick exhaust valves 50, 52 include pneumatic pilots 28 connected to the air source 12 for overcoming the spring 26 bias to force the quick exhaust valves 50, 52 to the open position. The first and second quick exhaust valves 50, 52 provide fast dumping of compressed air from the cylinder 54, eliminating the need for large plumbing and selector valves that are ordinarily required to accommodate exhaust air moving back through the pneumatic circuit 10.

Cylinder 54 is shown in FIG. 1 interposed between and in fluid communication via feed lines 14 with the first large booster 46 and first quick exhaust valve 50 and the second large booster 48 and second quick exhaust valve 52 at the respective first and second ends 58, 60 of the cylinder 54. Slidably disposed and sealed within the cylinder 54 is the piston 56. The piston 56 is connected to a shaft 62 which extends out of the cylinder 54, the shaft 62 being connectable to a component to be moved. Also optionally included in the pneumatic circuit 10 is a volume tank 22. In the schematic of FIG. 1, the volume tank 22 is shown disposed between and in fluid communication with the first and second small and large boosters 42, 44, 46, 48, via feed lines 14. The volume tank 22 is also fluidly connected to the directional valve 24 via a signal line 64. Finally, the volume tank 22 is fluidly connected to the compressed air source 12 via a feed line 14. Because the filter regulator 16 can only supply compressed air at a limited flow rate, the volume tank 22 may be added downstream of the filter regulator 16 to provide auxiliary compressed air during periods of high flow rate within the pneumatic control system 96. A volume tank check valve 30 may be installed between the volume tank 22 and the filter regulator 16, as can be seen in FIG. 1. The volume tank check valve 30 may be oriented to block the flow of compressed air from the volume tank 22 to the filter regulator 16, while allowing flow in the opposite direction. The volume tank 22 may be filled with compressed air and held at the pressure set by the filter regulator 16.

Figure 2:
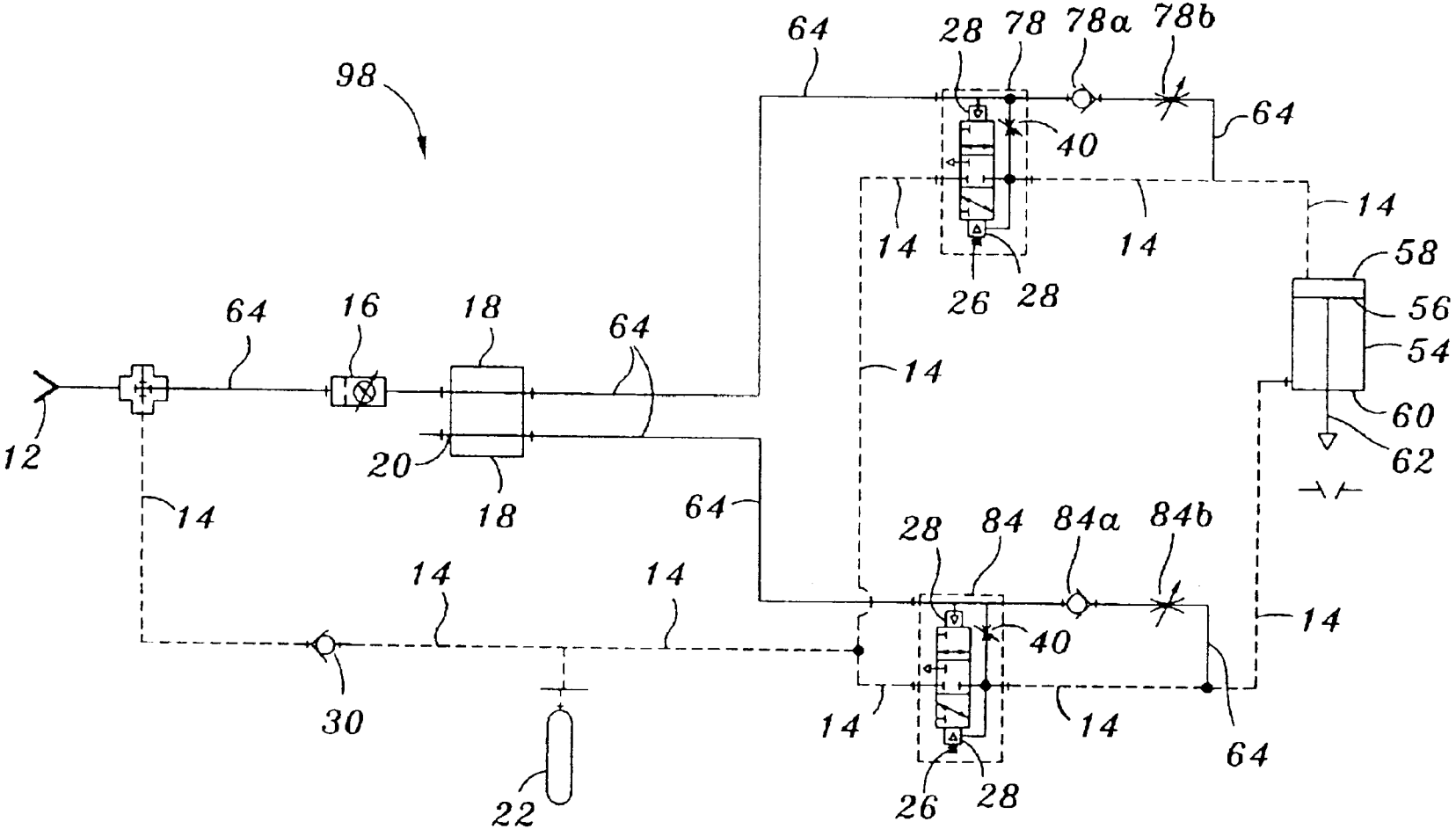
FIG. 2 is a schematic diagram of a piston positioning system illustrating the connective relationship of first and second booster check valves and adjustable restrictions with respective first and second boosters in accordance with a second embodiment of the present invention.

Turning now to FIG. 2, shown is a schematic diagram of a piston positioning system 98 illustrating the connective relationship of first and second booster check valves 78A, 84A and adjustable restrictions 78B, 84B with respective first and second boosters 78, 84 in accordance with a second embodiment of the present invention. The piston positioning system 98 is configured for positioning the piston 56 within the cylinder 54 by manipulating the compressed air. As in the first embodiment, the cylinder 54 has first and second ends 58, 60. The piston positioning system 98 includes the compressed air source 12 for providing compressed air to the pneumatic circuit 10. Optionally, a filter regulator 16 may be included in the pneumatic circuit 10, as can be seen in FIG. 2. The filter regulator 16 fluidly communicates with the source 12 of compressed air through a signal line 64 and reduces the pressurization level of the source 12 of air to a safe working level. The filter regulator 16 also filters the source 12 of compressed air to remove contaminates.

The positioner 18 of the piston positioning system 98 is fluidly connected to the compressed air source 12 via signal lines 64 for regulating the flow of compressed air into and out of the first and second ends 58, 60, as in the first embodiment. The first and second boosters 79, 84 are fluidly connected to and interposed between the positioner 18 and the respective first and second booster check valves 78A, 84A via signal lines 64 and feed lines 14 for alternately supplying and exhausting compressed air into and out of the cylinder 54. Similar to the connective relationship of the first and second small and large boosters 42, 44, 46, 48 of the first embodiment, the first and second boosters 78, 84 include pneumatic pilots 28 connected to the positioner 18 via signal lines 64. The first and second boosters 78, 84 are also connected to the compressed air source 12 via feed lines 14. The feed lines 14 are of larger diameter and capable of higher flow rates than the signal lines 64. Importantly, first and second booster check valves 78A, 84A are respectively fluidly connected in series to and interposed between respective first and second boosters 78, 84 and respective first and second ends 58, 60 via signal lines 64. The first and second booster check valves 78A, 84A are oriented such that the flow of compressed air away from respective first and second boosters 78, 84 toward respective first and second ends may be blocked.

The piston positioning system 98 also includes first and second booster adjustable restrictions 78B, 84B fluidly connected in series to and interposed between the respective first and second booster check valve 78A, 84A and the respective first and second boosters 78, 84. As can be seen in FIG. 2, the first and second booster adjustable restrictions 78B, 84B and check valves 78A, 84A are connected via signal lines 64 to the pneumatic pilot 28 of each of the first and second boosters 78, 84. Optionally, a directional valve 24 (not shown) may be fluidly connected to the positioner 18 and to the first and second boosters 78, 84 in a manner similar to that illustrated in FIG. 1 and described above. The directional valve 24 may be configured to open at a preset pressurization level of the compressed air for enabling the flow thereof to pass between the positioner 18, the compressed air source 12, and the cylinder 54. Advantageously, as described above in the first embodiment, the directional valve 24 may be set to open when the pressurization level reaches 50 psi. Conversely, the directional valve 24 may close when the pressure of the compressed air drops below 50 psi. In this regard, the directional valve 24 may be actuated into the fail safe mode such that upon a loss of pressure, compressed air may be delivered to the first end 58 of the cylinder 54 while exhausting cut of the second end 60 such that the piston 56 may be extended such that a valve connected to the shaft 62 may be closed.

Cylinder 54 is shown in FIG. 2 interposed between and in fluid communication with the first booster 78 and the second booster 84 at the respective first and second ends 58, 60 of the cylinder 54. Slidably disposed and sealed within the cylinder 54 is the piston 56. The piston 56 is connected to the shaft 62 extending out of the cylinder 54, the shaft 62 being connectable to a component to be moved. The piston positioning system 98 moves the piston 56 by forcing air into the first end 58 of the cylinder 54 while simultaneously withdrawing air out of the second end 60 of the cylinder 54. Conversely, the piston positioning system 98 may force air into the second end 60 of the cylinder 54 while simultaneously withdrawing air out of the first end 58 of the cylinder 54. By driving the air into alternate ends of the cylinder 54, the piston 56 is moved such that the shaft 62 can be displaced in any position.

Also optionally included in the piston positioning system 98 is the volume tank 22. In the schematic of FIG. 2, the volume tank 22 is shown disposed between and in fluid communication with the first and second boosters 78, 84 and the compressed air source 12. Because the filter regulator 16 can only supply compressed air at a limited flow rate, the volume tank 22 may be added downstream of the filter regulator 16. The volume tank 22 supplies compressed air to the piston positioning system 98 during periods of high flow rate. The volume tank 22 may also supply compressed air upon activation of the directional valve 24, if included, as a fail safe mechanism such that compressed air flows into the first end 58 and moves the piston toward the second end 60 in the extended position to close a working valve. The volume tank check valve 30 may be installed between the volume tank 22 and the filter regulator 16. The volume tank check valve 30 may be oriented to block the flow of compressed air from the volume tank 22 to the filter regulator 16, while allowing flow in the opposite direction.

The operation of the first embodiment illustrated in FIG. 1 will now be discussed. The air source 12 introduces the compressed air into the pneumatic circuit 10 at the filter regulator 16. The filter regulator 16 then reduces the pressurization level of the air source 12 to a safe working pressure. As was mentioned above, the filter regulator 16 may be set to a maximum of 150 psi. However, it is contemplated that there are a large number of settings for the filter regulator 16 that may be workable, depending on the downstream requirements and capacities of the pneumatic circuit 10 and its components. The compressed air then flows to the positioner 18.

The positioner 18 receives the compressed air from the filter regulator 16. The positioner 18 also receives a piston position signal indicating the position of the piston 56 in the cylinder 54. The positioner 18 converts the piston position signal to a pneumatic signal for controlling the position of a piston 56 within the cylinder 54. As was mentioned above, the piston position signal may be supplied to the positioner 18 through a pneumatic control line or it may be electronically transmitted to the positioner 18. The positioner 18 selectively provides compressed air to the cylinder 54 through one of two signal lines 64 in order to control the position of the piston 56. The compressed air then flows from the positioner 18 to the directional valve 24.

The directional valve 24 receives the compressed air from the positioner 18 and provides pneumatic signals via the two signal lines 64 to the first and second small and large boosters 42, 44, 46, 48. From the directional valve 24, the compressed air is selectively directed to the first and second small and large boosters 42, 44, 46, 48, depending on the routing by the positioner 18. The directional valve 24 includes a failsafe feature wherein the flow of compressed air through the signal lines 64 may be blocked in the case of a loss of pneumatic pressure.

At low flow rates, the first and second large boosters 46, 48 operate to selectively force compressed air into the respective first and second ends 58, 60 of the cylinder 54 through signal lines 64. At high flow rates, the pressure of the compressed air in the signal lines 64 activates the pneumatic pilots 28 of the first and second large boosters 46, 48, toggling the first and second large boosters 46, 48 to the supply node wherein the larger diameter feed lines 14 provide a high flow rate of compressed air into the respective first and second ends 58, 60. Simultaneously, at low flow rates, the compressed air alternately flows out of the first and second ends 58, 60, through the first and second quick exhaust valves 50, 52, thus exhausting compressed air out of the first and second small boosters 42, 44. However, as the flow rate out of the first and second ends 58, 60 increases, the pressure differential across the first and second quick exhaust valves 50, 52 in turn causes an increase in the pressure differential between the pneumatic pilots 28 of the first and second quick exhaust valves 50, 52, toggling the exhaust valves 50, 52 to the exhaust mode. The open first and second exhaust valves 50, 52 then allow for a very high rate of exhaustion of compressed air into the atmosphere.

The first and second small booster check valves 32, 34 operate to selectively isolate the first and second small boosters 42, 44 such that compressed air is blocked from flowing to the first and second small boosters 42, 44 whenever the first and second large boosters 46, 48 are opened by the positioner 18. Likewise, the first and second large booster check valves 36, 38 operate to isolate the first and second large boosters 46, 48 such that compressed air is blocked from flowing away from the first and second large boosters 46, 48. Advantageously, the first and second small booster check valves 32, 34 operate to selectively isolate the first and second small boosters 42, 44 such that compressed air is blocked from flowing into the first and second small boosters 42, 44. Likewise, first and second large booster check valves 36, 38 operate to isolate the first and second large boosters 46, 48 such that compressed air is blocked from flowing through the signal lines 64 toward the directional valve 24. By selectively isolating the first and second small and large boosters, 42, 44, 46, 48, the total volume of compressed air that would otherwise flow into the respective first and second small and large boosters 42, 44, 46, 48 is reduced. By reducing the total amount of compressed air that is required in order to effect a given movement of the piston 56, the speed with which the boosters may be activated is reduced. The reduced total volume of compressed air that would otherwise be required to effect a given movement of the piston 56 ultimately allows for more effective control of the piston 56 within the cylinder 54. In this regard, the first and second small booster check valves 32, 34 increase the responsiveness of the pneumatic control system 96 to pneumatic signal changes from the positioner 18.

The operation of the second embodiment will now be discussed. The air source 12 introduces the compressed air into the pneumatic circuit 10 at the filter regulator 16. The filter regulator reduces the pressurization level of the air source 12 to a safe working pressure. The filter regulator 16 also filters the source 12 of air to remove contaminates. The compressed air flows to the positioner 18 from the filter regulator 16 through the signal line 64. The positioner 18 receives the piston 56 position signal which represents the actual position of the piston 56 within the cylinder 54. The positioner 18 then converts the piston 56 position signal to a pneumatic signal. The pneumatic signal represents the desired position of the piston 56. In response to the pneumatic signal, the positioner 18 then directs the flow of compressed air alternately into the first and second ends 58, 60 in order to correct for disparity between the actual position of the piston 56 and the desired position of the piston 56. For relatively small pneumatic signals, the positioner 18 selectively provides compressed air to the cylinder 54 through the signal lines 64 at a relatively small flow rate.

For larger pneumatic signals, the pressure in the signal lines 64 is sufficiently large such that the first and second boosters 78, 84 are energized at the pneumatic pilots 28 such that they are toggled from the null position into the supply position. Air that is being exhausted out of the opposite end of the cylinder may also be characterized as a pneumatic signal which, if sufficiently large, is capable of triggering the pneumatic pilot located at the lower end of each of the boosters such that the boosters are toggled into the exhaust position. In the supply and exhaust positions, compressed air from the larger diameter feed lines 14 may alternately supply and exhaust compressed air into and out of the cylinder 54 at a high flow rate. Advantageously, the sensitivity of the first and second boosters 78, 84 in responding to pneumatic signals may be separately adjusted so that they toggle to either the supply or exhaust position at different points. The separate adjustments of the supply and exhaust sensitivity of each of the booster is provided by the arrangement of the first booster adjustable restriction 78B and second booster adjustable restriction 84B respectively connected in series to the first booster check valve 78A and the second booster check valve 84A, as can be seen in FIG. 2. As will be described in greater detail below, the ability to separately adjust the sensitivity of each booster such that they are activated by relatively small pressure signals in the supply mode while requiring large pneumatic signals for activation to the exhaust mode serves to improve the overall accuracy and dynamic stability of the piston positioning system 98.

By way of example, the operation of the boosters 78, 84 working in conjunction with the respective booster check valves 78A, 84A and booster adjustable restrictions 78B, 84B in moving the piston 56 from the first end 58 to the second end 60 will now be described. When the pneumatic signal is relatively small, the compressed air is insufficient to activate the pneumatic pilot 28 on the upper end of the first booster 78. With such small pneumatic signals, the flow of compressed air through the signal line 64 bypasses the first booster 78 and flows directly into the first end 58 of the cylinder 54 in order to extend the piston 56. The compressed air flows through the signal lines 64 toward the first booster 78, through the adjustable restriction 40, and into the first end 58 via the feed line 14 downstream of the first booster 78. As can be seen in FIG. 2, the first booster check valve 78A is oriented such that the flow of compressed air through the signal line 64 toward the cylinder 54 is blocked. The flow of compressed air is thus prevented from reaching the first booster adjustable restriction 78B. Simultaneous with the small flow of compressed air entering the first end 58, a proportionally small flow of compressed air exits the second end 60. The small flow of air exiting the second end 60 passes through the second booster adjustable restriction 84B and the second booster check valve 84A, bypassing the second booster 84 and eventually venting out of the positioner 18. Thus, at relatively small pneumatic signals, the first and second boosters 78, 84 are not activated into either the respective supply or exhaust positions. At such small flow rates, the first and second boosters 78, 84 will remain in the null position and the smaller diameter signal lines 64 carry the flow of air into and out of the first and second ends 58, 60 of the cylinder 54 at low flow rates.

However, for larger pneumatic signals, depending on the sensitivity adjustment of the adjustable restriction 40, the flow of compressed air through the signal line 64 may be sufficiently large enough such that the pneumatic pilot 28 at the upper end of the first booster 78 is activated. The activation of the upper pneumatic pilot 28 in turn toggles the first booster 78 into the supply position wherein compressed air coming from the larger diameter feed line 14 may now pass through the first booster 78 and enter the first end 58 at a high rate of flow, resulting in a greater responsive of piston 56 movement. Simultaneously, the increasing pressure of the compressed air acting upon the piston 56 at the first end 58 of the cylinder 54 generates a concomitant increase in the pressure of the compressed air at the second end 60 of the cylinder 54. The compressed air from the second end 60 is forced to flow into the feed line 14 toward the second booster 84. As can be seen in FIG. 2, the second booster 84 includes the second booster adjustable restriction 84B and the second booster check valve 84A collectively positioned in parallel to the second booster 84.

Importantly, the inclusion of the second booster adjustable restriction 84B connected in series with the second booster check valve 84A allows for the adjustment of the sensitivity of the second booster 84 in the exhaust mode without affecting the sensitivity of the second booster in the supply mode. This means that the first and second boosters can be activated into the supply posit on by very small pneumatic signals, but can only be activated into the exhaust position by large pneumatic signals. In this regard, the combination of the second booster adjustable restriction 84B with the second booster check valve 84A provides a means to control the point at which the second booster 84 is toggled to the exhaust position such that compressed air may be quickly exhausted out of the second end 60. When the boosters are in the null position, the compressed air exiting out of the second end 60 must flow through smaller diameter signal lines 64 before venting to the atmosphere at the positioner 18. However, the second booster adjustable restriction 84B may be adjusted so that a high differential pressure is required across the upper and lower pneumatic pilots 28 of the second booster 84 before the pneumatic pilot 28 on the lower end of the second booster 84 is activated such that the second booster 84 will toggle to the exhaust position and allow for the quick exhaustion of compressed air from the cylinder 54. The second booster 84 will only be toggled to the exhaust position when the pressure of compressed air flowing out of the second end 60 builds up to a predetermined point.

The second booster 84 will quickly toggle back to the null position as soon as the pressure differential across the upper and lower pneumatic pilots is reduced back to the predetermined point which may be set by adjusting the second booster adjustable restriction 84B such that the otherwise rapid flow of compressed air passing through the larger diameter feed lines 14 and out of the second booster 84 is blocked. This delay characteristic, wherein the second booster 84 is toggled to the exhaust position only when the pressure differential across the upper and lower pneumatic pilot 28 builds up to the predetermined point, provides a high degree of dynamic stability in that the piston 56 is prevented from overshooting the desired piston 56 position as it nears the end of its travel. The tendency for the piston 56 to overshoot the desired piston 56 position is reduced because the exhaust capacity of the pneumatic circuit 10 controls the speed with which the piston 56 is moved. By adjusting the second booster adjustable restriction 84B such that the second booster 84 will toggle out of the exhaust position before the piston 56 reaches the desired piston 56 position, the rate at which compressed air may flow out of the second end 60 is reduced as the piston 56 closes in on the desired piston 56 position. This reduction in the rate of flow out of the second end 60 correspondingly reduces the velocity of speed of the piston 56. The reduction in the speed of the piston 56 as it nears the desired piston 56 position lends a damping quality to the piston positioning system 98. This damping quality improves the accuracy and dynamic stability of the piston positioning system 96 and is due to the arrangement wherein the second booster adjustable restriction 84B is connected in series with the second booster check valve 84A and is collectively positioned in series with the second booster 84. The operation of the boosters in conjunction with the respective booster check valves 78A, 84A and the booster adjustable restrictions 78B, 84B in moving the piston 56 from the second end 60 to the first end is similar to that described above in moving the piston 56 from the first end to the second end 60.

Thus, in the operation described above, the individual booster may be adjusted to be very responsive to small pneumatic signal changes in the supply position. Such a high level of sensitivity of the boosters in the supply position may be achieved by increasing the restrictiveness of the adjustable restrictions 40 which are incorporated into each of the first and second boosters 78, 84. In addition, the individual boosters 78, 84 may be adjusted to respond only to very large pneumatic signal changes in the exhaust position. In this regard, the sensitivity of the boosters 78, 84 in responding to pneumatic signals transmitted by air exiting the first or second ends 58, 60 of the cylinder 54 is reduced by reducing the restrictiveness of the respective booster adjustable restrictions 78B, 84B.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A pneumatic control system for positioning a piston within a cylinder having first and second ends, the system manipulating a flow of compressed air such that the position of the piston may be regulated, the system comprising:

a compressed air source for providing compressed air to the pneumatic control system;

a positioner fluidly connected to the compressed air source for regulating the flow of compressed air into and out of the first and second ends;

a normally closed directional valve fluidly connected to the positioner and to the compressed air source, the directional valve configured to open at a preset pressurization level of the compressed air for enabling the flow thereof to pass between the positioner, the compressed air source, and the cylinder;

first and second large boosters fluidly connected to and interposed between the directional valve and respective ones of the first and second ends for supplying compressed air thereto;

first and second small boosters fluidly connected in series to respective ones of first and second quick exhaust valves interposed between the directional valve and respective ones of the first and second ends for collectively exhausting compressed air therefrom;

first and second small booster check valves fluidly connected to and interposed between the directional valve and respective ones of the first and second small boosters, the first and second small booster check valves being oriented such that the flow of compressed air away from the directional valve is blocked; and first and second large booster check valves fluidly connected to and interposed between the directional valve and respective ones of the first and second large boosters, the first and second large booster check valves being oriented such that the flow of compressed air towards the directional valve is blocked.

2. The pneumatic control system of claim 1 further comprising:

a piston position indicator mounted adjacent the cylinder for sensing an actual piston position within the cylinder and generating a piston position signal in response thereto, wherein the positioner converts the piston position signal to a pneumatic signal representative of a desired piston position such that the flow of compressed air may be alternately directed into the first and second ends for respectively retracting and extending the piston to correct for disparity between the actual piston position and the desired piston position.

3. The pneumatic control system of claim 1 further comprising:

an adjustable restriction fluidly connected in parallel to the first and second small and large booster check valves for minimizing the compressed air differential pressure thereacross by allowing a selectively restrictable flow of compressed air in a direction opposite that which is blocked by the first and second small and large booster check valves such that the first and second small and large boosters are prevented from allowing flow from the compressed air source to flow toward respective ones of the first and second ends.

4. The pneumatic control system of claim 3 wherein the adjustable restriction is a needle valve.

5. The pneumatic control system of claim 1 further comprising:

a filter regulator fluidly connected to the pneumatic fluid source for reducing the pressure thereof and filtering contaminants therein prior to entrance into the pneumatic circuit.

6. The pneumatic control system of claim 1 further comprising:

a volume tank fluidly connected to the compressed air source and the directional valve for storing pressurized compressed air for subsequent release into the pneumatic control system upon a loss of compressed air pressure.

7. The pneumatic control system of claim 6 further comprising:

a check valve fluidly connected to the volume tank and the compressed air source for blocking the flow of compressed air from the volume tank towards the compressed air source while allowing flow in an opposite direction.

8. A piston positioning system for positioning a piston within a cylinder having first and second ends, the system manipulating a flow of compressed air such that the position of the piston may be regulated, the system comprising:

a compressed air source for providing compressed air to the pneumatic control system;

a positioner fluidly connected to the compressed air source for regulating the flow of compressed air into and out of the first and second ends;

first and second boosters fluidly connected to and interposed between the positioner and respective ones of the first and second ends for alternately supplying and exhausting compressed air into and out of the cylinder;

first and second booster check valves fluidly connected in series to and interposed between respective ones of the first and second boosters and respective ones of the first and second ends, the first and second booster check valves being oriented such that the flow of compressed air away from the first and second boosters may be blocked; and first and second booster adjustable restrictions fluidly connected in series to and interposed between respective ones of the first and second booster check valves and respective ones of the first and second ends.

9. The pneumatic control system of claim 8 wherein the first and second booster adjustable restrictions are needle valves.

10. The piston positioning system of claim 8 further comprising:

a normally closed directional valve fluidly connected to the positioner and to the compressed air source, the directional valve being configured to open at a preset pressurization level of the compressed air for enabling the flow thereof to pass between the positioner, the compressed air source, and the cylinder.

11. The pneumatic control system of claim 8 further comprising:

a filter regulator fluidly connected to the pneumatic fluid source for reducing the pressure thereof and filtering contaminants therein prior to entrance into the pneumatic control system.

12. The pneumatic control system of claim 8 further comprising:

a volume tank fluidly connected to the compressed air source and the first and second boosters, the volume tank configured for storing pressurized compressed air for subsequent release into the pneumatic control system upon a loss of compressed air pressure.

13. The pneumatic control system of claim 12 further comprising:

a check valve fluidly connected to the volume tank and the compressed air source for blocking the flow of compressed air from the volume tank towards the compressed air source while allowing flow in an opposite direction.

* * * * *